US005324031A

United States Patent [19]

Green

[11] Patent Number: 5,324,031

[45] Date of Patent: Jun. 28, 1994

[54] GOLF PUTTER WITH A CORIAN PUTTERHEAD APPARATUS AND METHOD OF MANUFACTURE

[76] Inventor: Terry A. Green, 7119 W. Utopia Rd., Glendale, Ariz. 85308

[21] Appl. No.: 935,868

[22] Filed: Aug. 27, 1992

[51] Int. Cl.[5] ..... A63B 53/04

[52] U.S. Cl. ..... 273/78; 273/169; 273/173; 273/DIG. 16

[58] Field of Search ..... 273/167 R, 167 A-167 K, 273/168-175, 77 A, 78, DIG. 16

[56] References Cited

U.S. PATENT DOCUMENTS

| | | | |
|---|---|---|---|
| 3,815,910 | 6/1974 | Raines | 273/167 R |
| 3,836,153 | 9/1974 | Dance, Jr. | 273/173 |
| 3,843,122 | 10/1974 | Florian | 273/167 R |
| 3,881,733 | 5/1975 | Csernits | 273/167 R |
| 4,568,088 | 2/1986 | Kurahashi | 273/169 |
| 4,872,683 | 10/1989 | Doran et al. | 273/167 H |

*Primary Examiner*—Vincent Millin
*Assistant Examiner*—Steven B. Wong
*Attorney, Agent, or Firm*—Donald J. Lisa; Steven Lin

[57] ABSTRACT

A golf putter having a CORIAN putterhead [10] and a handle [110] affixed thereto. The putterhead is a three layer [20, 30, 40 ] hollow, [31], ear-shaped methacrylate sandwich fixedly encapsulating a variably sized lead shot weight filler [60, 70] in the hollow. Putting alignment inlays [50] are affixed in the top surface. The sandwich has a flat putting face [80] and a curvo-linear shaped body [90] the top edge of which is slanted [120]. The different colored CORIAN layers and alignment indicators add to the aesthetics of the putterhead. The CORIAN putting face [80] reduces the tendency of the golf ball to skid when it is contacted. The sandwich is made by adhering a hollowed [31] middle layer [30] to a flat end layer [20], inserting the lead shot [60] and resin filler [70], closing with a flat end layer [40 ] and shaping. The sandwich is then provided with the alignment inlays [50 ], final shaped [120], finished to a high luster and provided with a handle [110]. The layers [20, 30, 40] may each be made up of multiple layers [FIGS. 16, 17].

20 Claims, 5 Drawing Sheets

GOLF PUTTER WITH A CORIAN PUTTERHEAD APPARATUS AND METHOD OF MANUFACTURE

BACKGROUND OF THE INVENTION

1. The Field of the Invention

The present invention relates generally to a golf putter with a CORIAN[1] putterhead apparatus and its method of manufacture, and, more particularly, to a CORIAN putterhead that is multi-layered, multi colored, made from slab stock and interiorly encapsulates lead shots as weight means.

[1] CORIAN is a trademark of E. I. DuPont De Nemours and Company of Wilmington, Del. See, for example, U.S. Trademark Registration No. 821,790 registered Jan. 10, 1967.
The description and definition of CORIAN material is set forth infra in the specifications.

2. Discussion of Background and Prior Art

There are many putters with various types of putterheads available on the market today. The more common types are those with putterheads that are made from aluminum, steel, brass, or graphite. Putting is a very crucial aspect of a golfer's game. The type of putter a golfer uses can significantly affect his game because putterheads vary in the way they contact the golf ball. Aluminum, steel, brass, or graphite putterheads each have different surface characteristics which uniquely affects the golf ball when contacted. Results such as, the quality of control, speed, distance and accuracy of the ball, are all affected and dependent on the type of material used to manufacture the putterhead as well as other factors including the shape and weight of the putterhead. These various types of putters are widely used today.

One of the main problems with the existing putters is that a golf ball has a tendency to skid when it is first contacted by the putting face of the putterhead. This skid is analogous to an automobile skid. A skidding golf ball makes it more difficult to predict the speed, direction, and distance the ball will travel and, thus, more difficult to "hole-out".

Another problem with existing putters is that they do not provide enough resilience upon contacting a golf ball. This fact accounts in part for the ball's tendency to skid when it is hit. Aluminum, steel, and brass putters do not provide resilience because they are each made from metal. The graphite putter is made from carbon which also is not very resilient because it is too brittle and inflexible when finished.

A further problem with prior art putters is the absence of aesthetics. The color of present day putterheads is usually limited to the natural color, and a few variations, of the material from which it is made. This fact definitely limits the design and appeal of the putterhead since existing putters cannot be made from different layers of material which could incorporate different colors.

Thus, there is not available on the market today a golf putter with a putterhead made from a material that provides a more resilient contact with a golf ball. There is not available on the market today a golf putter with a putterhead made from CORIAN material. There is not available on the market today a golf putter with a putterhead made from multi-colored layers of CORIAN material which can provide great appeal to the aesthetics of the design of the putterhead.

OBJECTS OF THE INVENTION

It is an object of the present invention to provide a golf putter with a putterhead apparatus that is made from CORIAN methacrylate material.

It is another object of the present invention to provide a golf putter with a putterhead apparatus in which the putting surface has more resilience when contacting a golf ball.

It is another object of the present invention to provide for a golf putter with a putterhead apparatus that reduces the skid of a golf ball when it is contacted by the putterhead.

It is another object of the present invention to provide for a golf putter with a putterhead apparatus that is made with multiple layers of CORIAN slab stock.

It is a further object of the present invention to provide a golf putter with a putterhead apparatus that has greater aesthetics in the design of the putterhead due to the availability of multi-colored layers of CORIAN material.

It is a further object of the present invention to provide a golf putter with a CORIAN putterhead that allows the golfer to have better control of the speed, direction, distance, and accuracy of a putted golf ball.

It is a further object of the present invention to provide a golf putter with a CORIAN putterhead apparatus which is for either a right-handed golfer or a left handed golfer.

It is a further object of the present invention to provide a method of manufacturing a golf putter with a CORIAN putterhead that provides a shaped sandwich encapsulating lead shots as weight filler.

Additional objects, advantages, and novel features of the invention will be set forth in part in the description which follows, and in part will become apparent to those skilled in the art upon examination of the following, or may be learned by practice of the invention. The objects and advantages of the present invention may be realized and obtained by means of instrumentalities and combinations particularly pointed out in the appended claims.

SUMMARY OF THE INVENTION

Set forth below is a brief summary of the invention in order to achieve the foregoing and other objects in accordance with the purposes of the present inventions as embodied and broadly described herein, One aspect of the invention is a golf putter head apparatus made from methacrylate material to which is affixed a handle to form a putter.

A second aspect of the invention is a putterhead apparatus that includes a hollow CORIAN body layer sandwiched between a CORIAN sole layer and a CORIAN top layer encapsulating lead shots as weight means that are an integral part of the putterhead.

A further feature of this aspect of the invention is the inclusion of at least one alignment inlay placed in the top layer of the CORIAN putterhead.

Further features of this aspect of invention are an angulated top edge, a curved recessed heel and multicolored layers and alignment indicia.

Statement of Derived Benefits and Advantages

The present invention is a golf putter with a putterhead that is made from CORIAN slab stock. The CORIAN material provides the putterhead with a putting surface that is more resilient when the putterhead contacts the golf ball thereby reducing the skid. The CORIAN putterhead, therefore, gives the golfer better control of the speed, direction, distance, and accuracy when putting a golf ball. The present invention is also made from multi-colored layers of CORIAN which provides more appealing designs.

BRIEF DESCRIPTION OF THE DRAWINGS

The accompanying drawings, which are incorporated in and form a part of the specification, illustrate several embodiments of the present invention and, together with the description, serve to explain the principles of the invention. In the drawings.

DETAILED DESCRIPTION OF THE INVENTION

Figure 1:
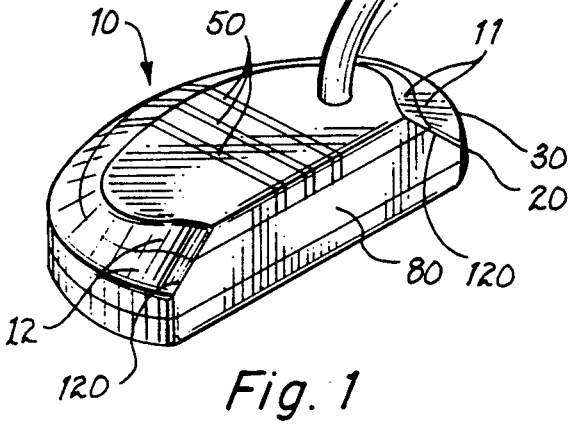
FIG. 1—Perspective view of the CORIAN putterhead for a right-handed golfer according to the first embodiment of the present invention with club shaft secured at a fixed angle to the putterhead.

FIG. 1 illustrates in perspective a first embodiment of the present invention showing a right handed tri-layered 20, 30, 40, ear-shaped, CORIAN putterhead 10. The lobe of the ear-shape is the putter heel 11. The top of the ear is the putter toe 12. In this first embodiment, as more clearly seen in FIG. 2, the invention has a curved recess in the heel 11 and also in the toe 12. The curved recesses add aesthetically to the design of the putterhead, and may vary in shape and depth without materially affecting the basic functions and features of the putterhead. The variations in the recess design depends on the method of manufacturing the putterhead, as described below. The alignment inlays 50 are clearly visible along with the front putting face 80, curvo-linear back 90 and hole 100 for receiving the golf handle 110.

Figure 2:
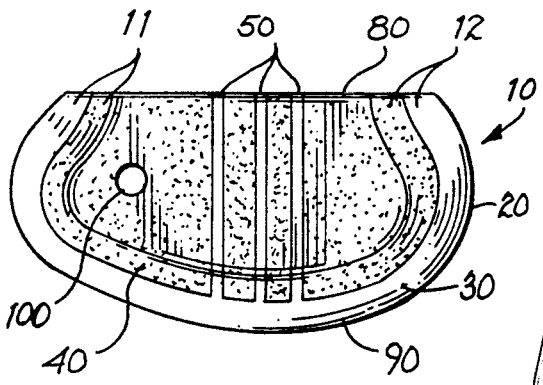
FIG. 2—Top elevational view of the ear-shaped CORIAN putterhead according to a first embodiment of the present invention.
Figure 3:
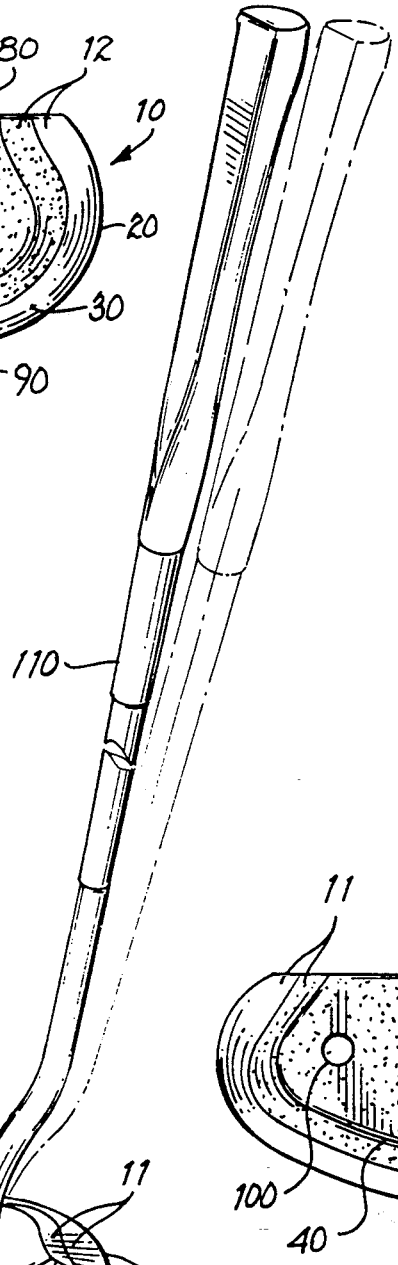
FIG. 3—Top elevational view of the ear-shaped CORIAN putterhead according to a second embodiment of the present invention.
Figure 3:
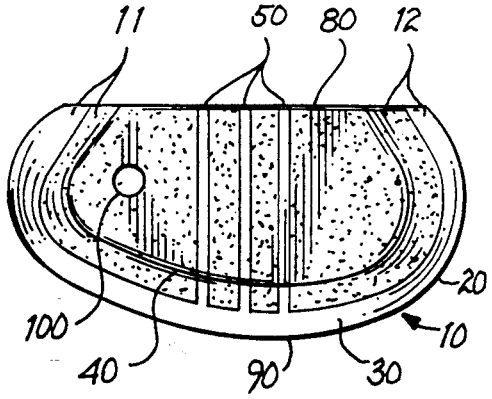

FIG. 3 shows the same CORIAN putterhead 10 as in FIG. 2, but FIG. 3 shows a second embodiment of the present invention. This second embodiment is almost identical to the first embodiment of FIG. 2 except that it does not have the curved recesses. Instead it has outwardly rounded edges at heel 11 and toe 12 of the putterhead.

Method of Manufacture

CORIAN material normally comes in one half inch (½") thick slab or sheet stock. CORIAN slab stock is a solid homogeneous material made from methacrylate material for general use in the construction and home furnishings industries. Methacrylate is a resinous type material. Methacrylate resin is a synthetic resinous plastic and incorporates a filler material, such as, calcium carbonate. It is a chemical filled acrylic polymer. It is also extensively used for window sills, thresholds, wainscot, showers, tub enclosures, vanity tops, bowl units, lawtories and countertops. The CORIAN slabs must be first cut to smaller strips for use in making the putterhead of the present invention. Typically, the material should be cut into strips two and five-sixteenth inches (2 5/16") wide and at least four and five-eighth inches (4 ⅝") long.

Figure 4:
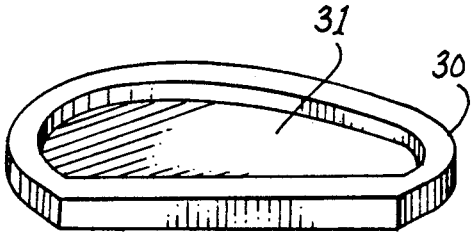
FIG. 4—Perspective view of the hollow, ear-shaped CORIAN body.

1. Making a Weight Shot Encapsulated Ear-Shaped Multi-Layered Corian Sandwich Multiple patterns of the putterhead hollow body are first sketched on the CORIAN strip. The template used to sketch this pattern has the hollow outline of the body 30 shown in FIG. 4. The hollow 31 of body 30 is formed by cutting out the center piece of CORIAN material. This step usually involves drilling starter holes in the interior of each pattern on the strip and then using a saber saw to cut out the remainder of the central portions of each pattern. Each pattern is then cut from the strip. The rounded edges of each body 30 are formed by trimming the excess material and sanding (i.e. typically using a disc sander) to the shape of the putterhead pattern.

Figure 5:
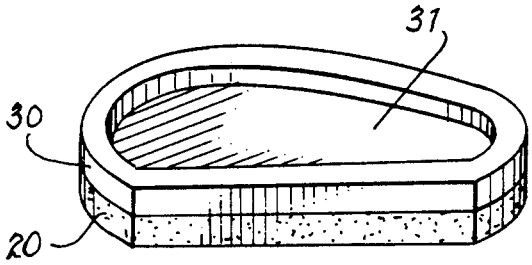
FIG. 5—Perspective view of the ear-shaped CORIAN body of the putterhead attached to another ear-shaped layer of CORIAN.

Next, another layer 20 ("the first layer 20") of CORIAN material is adhered to the body 30 as shown in FIG. 5.

This first layer 20 cut is obtained by lengthwise cutting typical ½" strips into a ¼" thickness and, then, cutting the ¼" thick strip into 2 5/16"×4 ⅝" pieces. The standard practice is that the non-cut side of the CORIAN material is the side that is laminated to any other layer of CORIAN material.

After the first layer 20 is laminated to the body 30, the excess edges are once again trimmed and the remaining edges are sanded (i.e. with a disc sander) to the same shape of the body 30. Normally, the cut side is made smooth using a belt sander. The lamination Joint is checked to make sure it is solid. The result of these steps is shown in FIG. 5. The assembled first layer 20 and body 30 act as means for receiving the weights of the putterhead as described below.

Figure 6:
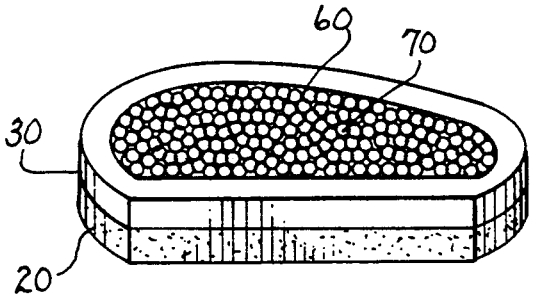
FIG. 6—Perspective view of the two attached layers of CORIAN material of FIG. 5 with lead shot weights interiorly affixed and sanded even with the top surface.

As shown in FIG. 6, the weight means 60 are then placed in the assembled CORIAN layers 20 and 30 of FIG. 5, and they are affixed thereto and to themselves by using weight attaching means 70. The function of weight means 60 is to impart desired amount of momentum to the golf ball for a given amount of velocity of the putterhead. Typically, the weight means 60 are lead shots. The size of the lead shots determines the weight of the putterhead and, thus, the weight of the putter. Larger size lead shots create a lighter weight putter. Smaller size lead shots create a heavier weight putter. For example, the standard #8 lead shots would be used to create a standard weight putter. The smaller #9 or #10 lead shots, however, would be used to create a heavier weight putter while the larger #5, #6, or #7 lead shots, on the other hand, would be used to create a lighter weight putter. Other weight means, such as, steel shot, powdered lead may be used and are deemed equivalent.

The weight attaching means 70 is a liquid resinous material and catalyst which are mixed and used as a filler and which become hard when it is mixed and cured. The resin and catalyst are well known products sold under the brand names Wren and Reichhold, respectively. The weight attaching means 70 has three functions. The first function is to adhere the lead shots (i.e. weight means 60) to each other. The second function is to adhere the weights to the CORIAN layers 20 and 30. The third function is to fill the spaces that are in between the lead shots. Other types of resin filler are acrylic and polyester resins which are deemed equivalent.

The weighting system that has just been described is unique and can be used in a variety of applications in which weights need to be varied. This weighting system, of course, can be used in all types of putters and is not limited to be used for only methacrylate putters.

This unique and novel weighting system comprises an enclosed structure that typically houses weight shots that can be of variable sizes which are affixed to each other and affixed to the housing structure. The weighting system is further comprised of filler which fills in the spaces (or voids) between the weight shots. The weight shots are typically lead shots, but they are not limited to just this type of material. The larger shots are normally heavier than the lighter shots.

The principle behind the weighting system is that a larger number of smaller, lighter shots will be used in comparison to the number of larger, heavier shots to fill the same volume of an enclosed structure. The overall effect will be that the larger number of smaller shots will be heavier than the smaller number of larger shots in filling the same volume structure. The resin filler that fills the spaces between the weight shots is light and uniform in weight.

If the filler occupies more space (or voids), then the overall weight of the putter will be made lighter. The weight of the putter is therefore a function of the density, shape, and size of the weight shots and also a function of the density of the filler.

The lead shots 60 and 70 resin filler are placed in the CORIAN layers 20 and 30 in such a way that they are filled to the top and pushed to every corner in hollow 31 so that a solid center is created. After the lead shot and resin filler mixture is cured, the surface of the solid center is sanded (i.e. typically using a disc sander) to create a good smooth surface that is even with the top surface of body 30. The result of these steps is shown in FIG. 6.

Figure 7:
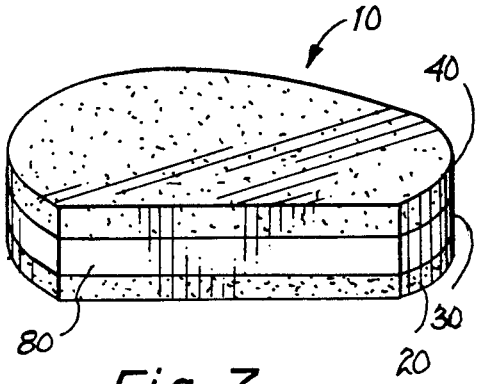
FIG. 7—Perspective view of three assembled ear-shaped, layers of CORIAN material encapsulating the lead shot weights.

Another CORIAN layer is attached to the top surface of body 30 in FIG. 6. Referring to FIG. 7, this step is accomplished by laminating the smooth side of a third layer 40 of CORIAN material, which has dimensions 2 5/16"×4 ⅝×¼". This is achieved by using conventional CORIAN joint adhesives. This third layer 40 is then trimmed of the excess edges and sanded (i.e. typically using a disc sander) so that it is of the same shape of the body 30 and first layer 20. The lamination joint is then checked to insure that it is a solid joint. The result of these steps is shown in FIG. 7.

At this point in the manufacturing process, it must be decided whether a putter for a right handed golfer or a putter for a left handed golfer is to be manufactured. For example, as illustrated in FIG. 7, if a right handed putter is to be manufactured, the top of the putter would be third layer 40 and the sole of the putter would be first layer 20. If, however, a left handed putter is to be manufactured, then the device as shown in FIG. 7 must be flipped upside down so that the top of the putter is layer 20 while the sole of the putter is layer 40.

After deciding which handed putter is to be made, the top of the putterhead is sanded (i.e. typically using a belt sander) to create a smoother surface. The bottom of the sole is then sanded next. The face 80 in FIGS. 2 or 3 of the putterhead is then sanded and shaped to the desired degree of loft angle. Usually, the loft angle of the face 80 may vary up to plus or minus ten degrees from the vertical.

The bottom edge of the putterhead between the face 80 and the sole (i.e. either layer 20 or layer 40 depending on whether the putter is right handed or left handed) is sanded to a ¼" rounded edge of about ¼" radius. This rounded edge helps to prevent the club from digging into the turf during putting.

2. Affixing Alignment Inlays

Figure 8:
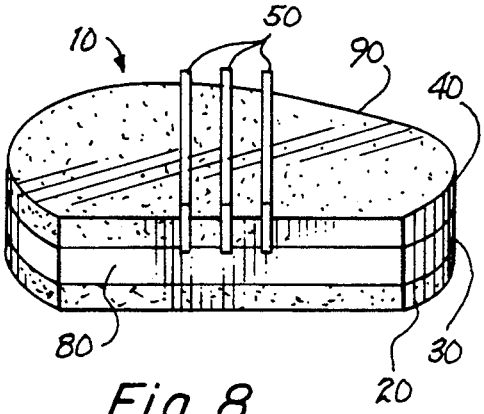
FIG. 8—Perspective view of the three assembled layers of FIG. 7 with three affixed alignment inlays before they are shaped into the form of the putterhead.

Alignment inlays may then be attached to the top layer of the putterhead. This feature is optional, but highly desired. In FIG. 8, layer 40 is the top layer. The number of alignment inlays and where they are placed may vary, but typically, either one, two, or three inlays are attached to the putterhead. Grooves are cut into the top layer 40 of FIG. 7. These grooves are cut starting from face 80 and ending at back side 90. Typically the grooves are five-sixteenth inches (5/16") in depth and one sixteenth inch (1/16") in width. Thus, the grooves extend into layer 30 about 1/16 ".

Normally, the center of face 80 is identified and marked. In most cases, the center of the face is about one and five-eighths inches (1 ⅝") from the heel of the putterhead measured along the edge of the top surface 40. If there is only one alignment inlay, then it is placed at the center of the top layer 40. If there are two alignment inlays, then they are placed so that they straddle the center line of the face, as determined above. In most instances, the two inlays would be placed about five-sixteenth inches (5/16") apart straddling the face center line. If there are three alignment inlays, then one of the inlays is placed on the center line of the top layer 40 while the other two inlays are placed straddling the center line of the face. Typically for three inlays, there is a five-sixteenth inch (5/16") separation between each inlay.

The alignment inlays are then cut to size, which is typically one sixteenth inch (1/16") in thickness, one half (½") in depth, and two and five sixteenth (2 5/16") inches in length. In FIG. 8, the alignment inlays 50 are shown inserted and affixed in the grooves of the top layer 40. Alignment inlays 50 are normally different in color than the top layer so that the inlays 50 are quite distinguishable to the golfer and further add to the aesthetics of the design of the putter.

Figure 9:
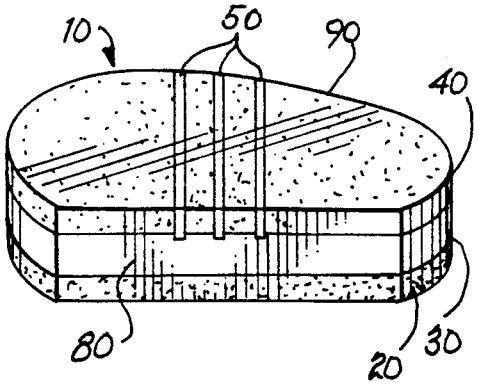
FIG. 9—Perspective view of the three assembled layers of FIG. 8 with the three affixed alignment inlays after they have been shaped into the form of the putterhead.

The inlays 50 are affixed in the grooves of the putterhead 10 by using conventional CORIAN joint adhesives described above. After the inlays 50 have cured, the lamination joints are inspected to insure that solid joints exist. The inlays 50 are then sanded (i.e. typically using a disc sander) to be even with the surface of the top layer 40 and to also be even with face 80 and back 90 of the putterhead. The result of these steps is shown in FIG. 9.

3. Final Shaping and Finishing

The curvo-linear top edge portion of the ear-shaped putterhead is then cut to a predetermined angle 120 as shown in FIGS. 1, 11–15. This slanted edge is typically achieved in either of two ways: 1) by using a router or 2) by using a sander. As an example, a forty-five degree (45°) angle is cut around the top edge 120 portion of the putterhead. If a router is used to cut the forty-five degree angle, a forty-five degree cutting blade that is a minimum of one and one quarter inch (1 ¼") in length along with a guide roller at the end of the blades is typically used, and the cut should start approximately one half inch (½") from the very bottom of the putterhead.

Use of a sander to cut the angle achieves the same result. The use of a router, however, has the advantage of being much faster than a sander. The putterhead is then finally inspected and any dry joints that exist are filled in at this point.

The putterhead is then finish sanded and buffed which creates a fine, smooth surface. These steps can be accomplished through the use of a dual-action, air powered sander and using various types of sandpaper (i.e., using sandpaper in the following order: 1) 80 grit paper; 2) 180 grit paper; 3) 320 grit paper; 4) 400 grit paper; 5) polishing compound with buffing wheel.)

Figure 10:
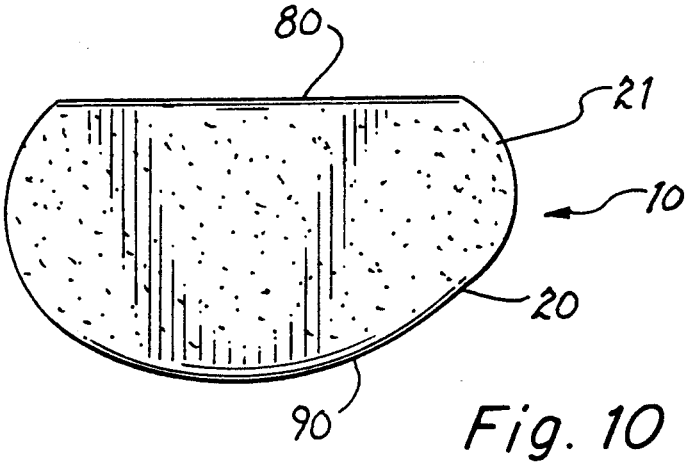
FIG. 10—Bottom elevational view of the ear-shaped CORIAN putterhead.
Figure 11:
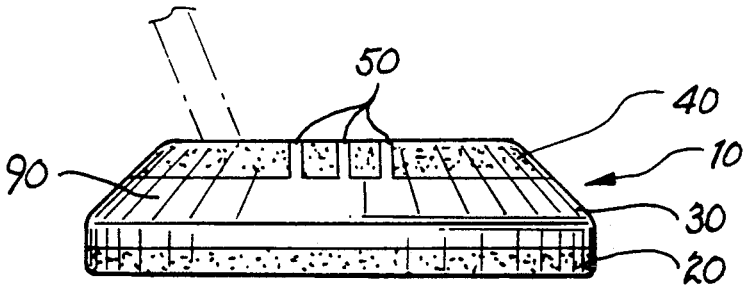
FIG. 11—Back elevational view of the CORIAN putterhead of the first and second embodiments of FIGS. 2 and 3.
Figure 12:
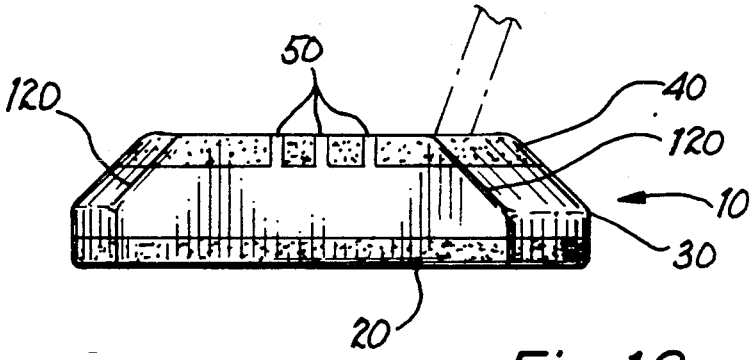
FIG. 12—Front elevational view of the CORIAN putterhead of the first and second embodiments of FIGS. 2 and 3.

FIGS. 10–15 show the putterhead after the forty=-five degree angle has been cut and after sanding, buffing, and polishing of the putterhead. FIG. 10 shows a bottom elevation view of the putterhead 10, and it specifically shows the bottom 21 of the putterhead sole 20. FIG. 11 shows the back elevation view of the putterhead 10, and FIG. 12 shows a front elevation view of the putterhead 10 which specifically shows the face 80 and multi-layers of the putterhead.

Alternative Embodiments

Figure 13:
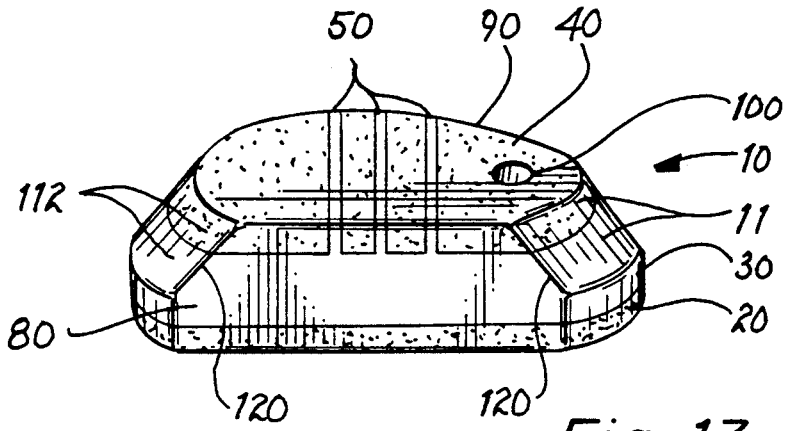
FIG. 13—Perspective view of the CORIAN putterhead for a right-handed golfer according to the second embodiment of the present invention.

FIG. 13 shows a perspective view of an embodiment of the CORIAN putterhead 10 which is for a right handed golfer. This determination is indicated by the hole 100, which is the means for attaching the shaft of the club handle to the putterhead, being located on the right side of FIG. 13 near the heel 11. The embodiment shown in FIG. 13 would typically be manufactured by the sanding of the entire, curvo-linear top edge 120 of the putterhead 10 at a forty-five degree angle since there are no inward curved recesses at heel 11 or toe 12 of the putterhead.

FIG. 1, however, is an almost identical CORIAN putterhead as shown in FIG. 13 except that there are inward curved recesses in heel 11 and toe 12. The putterhead as shown in FIG. 1 would typically be manufactured by the router since the router would leave these curved features when the putterhead in FIG. 9 is being shaped to have the forty-five degree angled edges 120. The putterhead shown in FIG. 1 is for a right handed golfer since the hole 100 for attaching the golf handle is on the right side of FIG. 1 near the heel 11.

Figure 14:
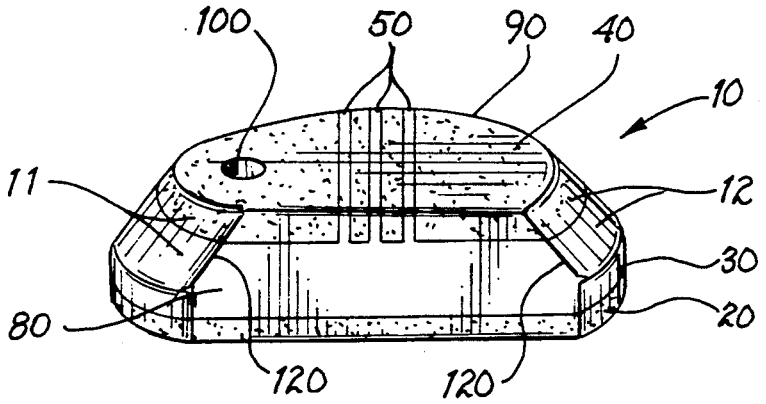
FIG. 14—Perspective view of the CORIAN putterhead for a left-handed golfer according to the second embodiment of the present invention.
Figure 15:
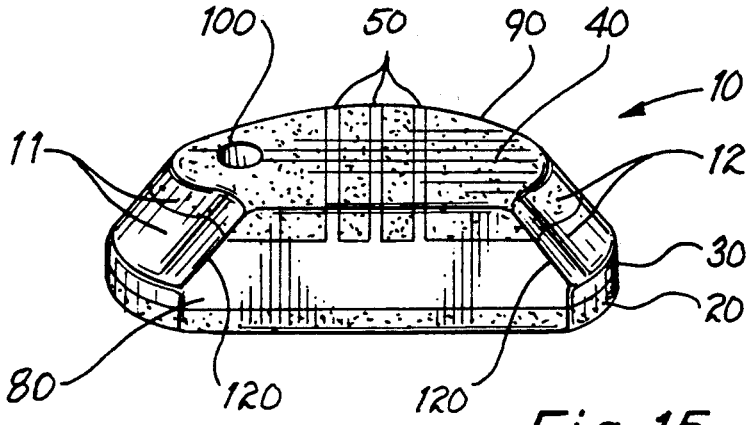
FIG. 15—Perspective view of the CORIAN putterhead for a left-handed golfer according to the first embodiment of the present invention.

The putterheads shown in FIGS. 14 and 15 are almost identical to the putterheads shown in FIGS. 13 and 1, respectively, except that the putterheads shown in FIGS. 14 and 15 are the alternative embodiments which are for a left handed golfer. This is indicated by the hole 100, which is the means for attaching the shaft of the golf handle, being on the left side in FIGS. 14 and 15 near the heel 11.

The shaft of the golf handle is then secured to the putterhead 10. This is usually accomplished by drilling a hole near the heel in the top of the putterhead. This step is shown as hole 100 in FIGS. 1, 13–15. The hole is usually drilled through the top layer 40 and into the weight means 60 and weight attaching means 70. As described earlier in the attachment of the weight means, the weight shots are adhered to each other by a filler (i.e. resin filler) which hardens. These weight shots that are adhered together provide the putterhead with a solid surface and solid foundation for a shaft to be attached to when a hole is drilled in the putterhead for the insertion of the shaft. The hole 100 is usually a three eights inch (⅜") in diameter round hole and is three quarters inch (¾") in depth. The hole 100 is also typically one inch (1") from the heel of the putterhead measured along the top surface.

The lie angle of the putter is determined by the way the hole 100 (i.e. the means for attaching the shaft to the putterhead) is drilled. For example, if the hole 100 is drilled at a twenty degree (20° ) angle from the vertical towards the heel of the putterhead and the golfer when holding the club, then the lie angle of the putter would in turn be the standard twenty degrees (20°). Obviously, the lie angle of the putter may vary according to the angle at which the hole 100 is drilled. This feature is shown in dotted lines in FIG. 1. The shaft of the golf handle is then affixed to the putterhead by use of conventional epoxy, such as epoxy sold under the brand name Conap, and any excess epoxy must then be cleaned off. The shaft of the golf handle, of course, can then be cut to any desired length, and the shaft which is used may be of any type that the manufacturer desires.

Layers 20, 30, and 40 of FIGS. 1, 13, 14, and 15 can also each be made up of multiple layers of material. A variable number of layers may be used to construct these layers.

Figure 16:
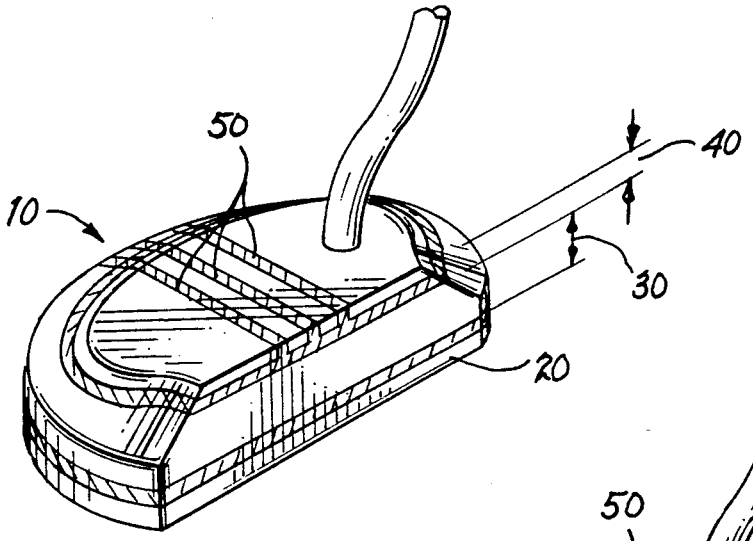
FIG. 16—Perspective view of the CORIAN putterhead according to the third embodiment of the present invention.

FIG. 16 shows a perspective view of the CORIAN putterhead 10 according to a third embodiment of the present invention. In this third embodiment, the features of the apparatus and method of manufacture are basically the same as those which were described for the first and second embodiments. The main difference, however, is that the third embodiment is comprised of a layer 20 and a layer 40 that is each made from laminating two thinner layers that are of different colors. The third embodiment provides a putterhead that look as though it has five layers.

Figure 17:
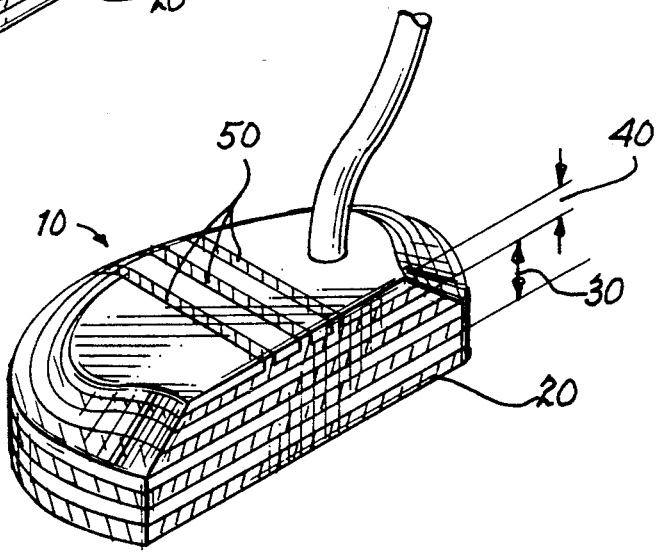
FIG. 17—Perspective view of the CORIAN putterhead according to the fourth embodiment of the present invention.

FIG. 17 shows perspective view of the CORIAN putterhead 10 according to a fourth embodiment of the present invention. In this fourth embodiment, the features of the apparatus and method of manufacture are also basically the same as those which were described for the third embodiment. The additional feature which the fourth embodiment has, however, is that the body layer 30 is made from laminating four thinner layers that are of different colors. The fourth embodiment provides a putterhead that looks as though it has eight layers which alternate in color.

These layers 20, 30, and 40 that can each be made of multiple layers are not limited to providing a putterhead that looks like it either has five or eight layers. These layers 20, 30, and 40 obviously can be comprised in a number of ways to provide a putterhead that looks like it has any number of layers.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described as the best mode known to the invention and best explains the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A golf putter comprising:

a methacrylate putterhead adapted to receive a shaft comprising:

a first layer of methacrylate material that is the sole of the putterhead;

a second layer of methacrylate material that is the body of the putterhead;

a third layer of methacrylate material that is the top of the putter head;

weight means that are an integral part of the putterhead;

means for attaching the weight means to the methacrylate material;

means for attaching the layers of methacrylate material together;

a first cross-sectional side of the putterhead that comprises the face; and a second cross-sectional side of the putterhead that comprises the back, and a shaft affixed to the putterhead as a golf handle for the putter.

2. A methacrylate putterhead apparatus comprising:

a first layer of methacrylate material that is the sole of the putterhead;

a second layer of methacrylate material that is the body of the putterhead;

a third layer of methacrylate material that is the top of the putterhead;

weight means that are an integral part of the putterhead;

means for attaching the weight means to the methacrylate material;

means for attaching the layers of methacrylate material together;

a first linear cross-sectional side of the putterhead that comprises the face; and a second curvo-linear cross-sectional side of the putterhead that comprises the back.

3. A methacrylate putterhead apparatus according to claim 2 further comprising;

at least one alignment inlay attached to the putterhead.

4. A methacrylate putterhead apparatus according to claim 2 wherein the means for attaching the weight means to the methacrylate material include:

means for placing the weights inside the methacrylate putterhead; and resin filler for adhering the weights and methacrylate material together.

5. A methacrylate putterhead apparatus according to claim 4 wherein the means for placing the weights inside the methacrylate putterhead is provided by the body layer of methacrylate material being hollow and the contiguous sole and top layers of methacrylate material being solid.

6. A methacrylate putterhead apparatus according to claim 2 wherein the top edge of the curvo-linear side of the putterhead is inwardly slanted.

7. A methacrylate putterhead apparatus according to claim 2 wherein the weight means that are an integral part of the putterhead are lead shots, the weight of the putter being a function of the size and number of lead shots.

8. A methacrylate putterhead apparatus according to claim 2 further comprising means for attaching a shaft of a golf putterhead handle to the methacrylate putterhead.

9. A methacrylate putterhead apparatus according to claim 8 wherein the means for attaching the shaft of the golf putterhead handle to the methacrylate putterhead include means for inserting the shaft into the methacrylate putterhead at an angle which determines the lie angle of the putterhead.

10. A methacrylate putterhead apparatus according to claim 2 wherein the face of the putterhead has a loft angle.

11. A methacrylate putterhead apparatus according to claim 2 wherein the face provided by the methacrylate material when contacted with golf ball reduces the amount of skid on the ball.

12. A methacrylate putterhead apparatus according to claim 2 wherein the putterhead is made for a right-handed golfer.

13. A methacrylate putterhead apparatus according to claim 2 wherein the putterhead is made for a left-handed golfer.

14. A methacrylate putterhead apparatus according to claim 2 wherein the first layer of methacrylate material that is the sole of the putterhead comprises of a number of thinner multiply laminated layers of methacrylate material.

15. A methacrylate putterhead apparatus according to claim 14 wherein the first layer that is the sole of the putterhead comprises of two thinner laminated layers of methacrylate material.

16. A methacrylate putterhead apparatus according to claim 2 wherein the third layer of methacrylate material that is the bottom of the putterhead comprises of a number of thinner multiply laminated layers of methacrylate material.

17. A methacrylate putterhead apparatus according to claim 16 wherein the third layer that is the bottom of the putterhead comprises of two thinner laminated layers of methacrylate material.

18. A methacrylate putterhead apparatus according to claim 2 wherein the second layer of methacrylate material that is the body of the putterhead comprises of a number of thinner multiply laminated layers of methacrylate material.

19. A methacrylate putterhead apparatus according to claim 18 wherein the second layer of methacrylate material that is the body of the putterhead comprises of four thinner laminated layers of methacrylate material.

20. A methacrylate putterhead apparatus comprising:

a first layer of methacrylate material that is the sole of the putterhead;

a second layer of methacrylate material that is the body of the putterhead;

a third layer of methacrylate material that is the top of the putterhead;

weight means that are an integral part of the putterhead;

means for attaching the weight means to the methacrylate material; means for attaching the layers of methacrylate material together;

a first cross-sectional side of the putterhead that comprises the face; and a second cross-sectional side of the putterhead that comprises the back.

* * * * *